United States Patent [19]

Sakakibara et al.

[11] 4,266,517

[45] May 12, 1981

[54] DIFFERENTIAL PRESSURE SWITCH DEVICE RESPONSIVE TO DIFFERENTIAL PRESSURE AND TEMPERATURE CHANGE

[76] Inventors: Naoji Sakakibara, 21, Shiokaki, Takara-Machi Chiryu city, Aichi pref.; Nobuyuki Hashimoto, 30-18, Kamisaka, Nakata-cho, Toyota-city, Aichi Pref., both of Japan

[21] Appl. No.: 50,865

[22] Filed: Jun. 21, 1979

Related U.S. Application Data

[63] Continuation of Ser. No. 854,381, Nov. 23, 1977, abandoned.

[30] Foreign Application Priority Data

Nov. 24, 1976 [JP] Japan ..... 51-141609

[51] Int. Cl.[3] ..... H01H 35/34

[52] U.S. Cl. ..... 123/333; 335/208; 200/83 L; 200/81.5

[58] Field of Search ..... 200/81 R, 81.5, 61.2, 200/84 B, 84 C, 82 E, 83 L, 83 A, 83 R, 83 S; 335/208, 146; 123/399, 325, 333

[56] References Cited

U.S. PATENT DOCUMENTS

| | | | |
|---|---|---|---|
| 2,927,176 | 3/1960 | Auld, Jr. | 200/84 C |
| 3,342,959 | 9/1967 | Breunich | 200/83 L |
| 3,649,936 | 3/1972 | Masuda | 335/208 |
| 3,654,956 | 4/1972 | Tsubouchi | 200/84 C |
| 3,946,175 | 3/1976 | Sitabkhan | 200/83 L |
| 3,978,299 | 8/1976 | Takai | 335/208 |
| 4,084,072 | 4/1978 | Tsubota | 200/83 S |

OTHER PUBLICATIONS

IBM Tech. Discl. Bull., Multiconfiguration Pressure Switch, Bolan et al., vol. 8 No. 7, Dec. 1965.

*Primary Examiner*—Gerald P. Tolin

*Attorney, Agent, or Firm*—Oblon, Fisher, Spivak, McClelland & Maier

[57] ABSTRACT

A differential pressure switch device having a flexible diaphragm between two chambers subject to differential pressure, a permanent magnet movable with the diaphragm against a biasing force when pressure differences occur in the chambers, a thermo ferrite combined with the magnet for cooperation therewith, and a reed switch assembly actuated by the movement of the magnet and through the action of the thermo ferrite which becomes magnetic or non-magnetic depending on the temperature.

8 Claims, 10 Drawing Figures

DIFFERENTIAL PRESSURE SWITCH DEVICE RESPONSIVE TO DIFFERENTIAL PRESSURE AND TEMPERATURE CHANGE

This is a continuation of application Ser. No. 854,381, filed Nov. 23, 1977, now abandoned.

BACKGROUND OF THE INVENTION

1. Field of the Invention

This invention relates to differential pressure switch devices and more particularly to a new and improved differential pressure switch device being operable in response to both differential pressure and changes in temperature.

2. Description of the Prior Art

There have been known in the art a differential pressure switch device suited for use as a controlling device incorporated within, for example, an internal combustion engine control system for preventing the known undesired pollution gases from being exhausted from automotive vehicle engines. The capacity of the engine depends largely on temperatures of the engine. Accordingly, it is essential to control the engine system by the temperature of the engine in order to maximize the capacity of the engine.

However, since conventional differential pressure switch devices are operable in response to pressure regardless of temperature, it is necessary to employ a device operable in response to temperature to attain the above-noted purpose.

SUMMARY OF THE INVENTION

One general object of this invention therefore, is to provide a new and improved differential pressure switch device operable in response to differential pressure.

More specifically, it is an object of this invention to provide a differential pressure switch device having a single housing and being operable in response to both differential pressure and changes in temperature.

Another object of this invention is to provide a new and improved differential pressure switch device, utilizing comparatively simple mechanical components, which is economical to manufacture and thoroughly reliable in operation.

In practicing this invention, a flexible diaphragm movable in response to differential pressures between two chambers facing opposed sides of the diaphragm against a biasing force is employed, and a permanent magnet and a thermo ferrite combined with the magnet, movable with the diaphragm, is provided for actuating a reed switch.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
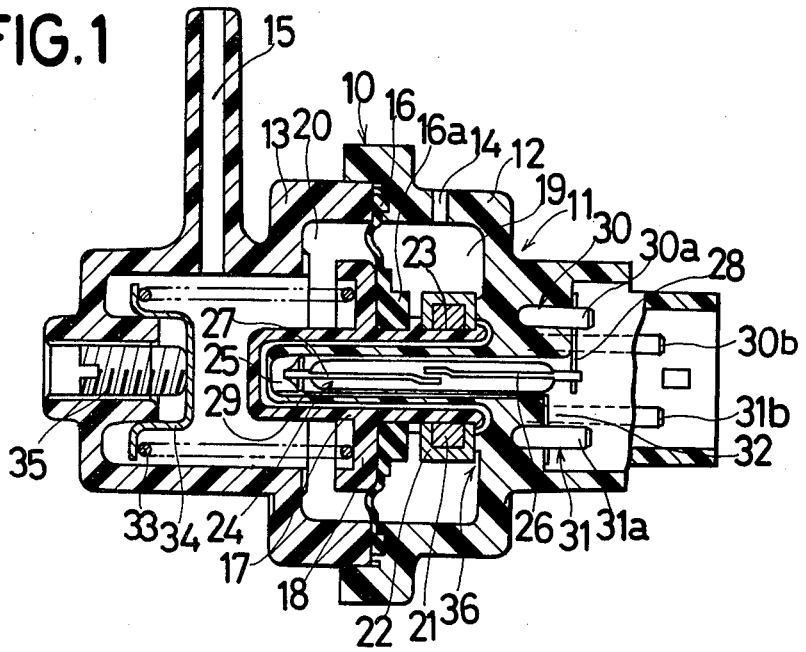
FIG. 1 is an enlarged cross-sectional view of a first embodiment of this invention.
Figure 2:
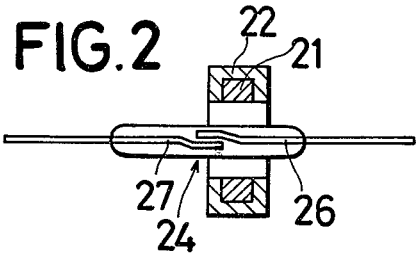
FIG. 2 is a diagram of a normally open type switch assembly at a temperature over its Curie temperature consisting of a thermo ferrite in the first embodiment.

Referring now particularly to FIG. 1 of the drawings, a differential pressure switch device of the present invention is generally indicated by reference numeral 10. As illustrated in FIG. 1, switch device 10 includes a switch housing 11 having a first housing member 12 and a second housing member 13 which are formed of a non-conductive material such as synthetic resin. The open ends of the first and second housing members 12 and 13 are connected to each other by a suitable connection such as an ultrasonic deposition.

The first housing member 12 has an air inlet port 14 for connection to an atmospheric source, while the second housing member 13 has a vacuum inlet port 15 for connection to a vacuum source. An annular flexible diaphragm 16 is rigidly secured at the outer periphery thereof between the first and second housing members 12 and 13. The diaphragm 16 is fabricated from rubber or other suitable flexible material to enable movement of the center portion **16*a* thereof in response to pressure changes within the housing 11**.

A movable cylindrical member 17 has a flange 18 at the middle portion thereof and to which the inner periphery of diaphragm 16 is secured. Thus, within the first and second housing members 12 and 13 a first chamber 19 and a second chamber 20 are sealingly defined by diaphragm 16 and by cylindrical member 17. Inlet ports 14 and 15 are in communication with the interiors of chambers 19 and 20 respectively. The cylindrical member 17 is formed of non-conductive material such as a synthetic resin.

A permanent annular magnet 21 covered with a thermo ferrite 22 to hold magnet 21 and is securely disposed in an annular recess 23 provided on the outer peripheral surface of the right of flange 18.

Switch device 10 further includes a reed switch assembly 24 which is disposed in an inner core or hollow projection 25 of the first housing member 12. Inner core 25 serves as a switch capsule, and is disposed within the cylindrical member 17. Contact points 26 and 27 of the reed switch assembly 24 are each electrically connected to one end of plates 28 and 29, respectively.

A pair of U-shaped connectors 30 and 31 are securely mounted in first housing member 12 as shown. Both ends of each connector are exposed in the recessed portion 32 of first housing member 12. One exposed end 30*a* of connector 30 is connected to one contact 26 of switch assembly 24 via plate 28, while one end 31*a* of connector 31 is connected to the other contact 27 of switch assembly 24 via plate 29. It should be noted that all elements 28, 29, 30 and 31 are formed of conductive metal material. The other ends 30*b* and 31*b* of connectors 30 and 31, respectively, serve as the terminals of switch device 10.

A compressed coil spring 33 is axially positioned within second chamber 20. One end of spring 33 engages with flange 18 of the cylindrical member 17, while the other end of spring 33 abuts a thrust washer 34 near the closed end of second housing member 13. The axial position of thrust washer 34 is adjustable by means of an adjusting screw 35 adapted to be threadedly disposed in a threaded aperture of the closed end of second housing member 13, thereby varying the degree of compression of spring 33.

Diaphragm 16 as well as cylindrical member 17 are always biased toward the right by the force of spring 33. In the absence of the pressure difference between first and second chambers 19 and 20, respectively, thermo ferrite 22 is in contact with the inner stop surface 36 of first housing member 12 and cylindrical member 17 is maintained in its rest position.

The thermo ferrite 22 is formed of a ferromagnetic substance which becomes a non-magnetic substance over its Curie temperature. Since thermo ferrite 22 becomes a magnetic substance below its Curie temperature, the magnetic flux of permanent magnet 21 forms a closed loop through thermo ferrite 22 below its Curie temperature. Accordingly, no matter where the position of the thermo ferrite 22 holding the magnet 21 therein is, when below its Curie temperature, the contacts 26 and 27 of the reed switch assembly 24 are disengaged from or open to each other. On the other hand, the thermo ferrite 22 becomes a non-magnetic substance over its Curie temperature.

When the vacuum in chamber 20 increases, the pressure difference between the first and second chambers 12 and 13 will cause cylindrical members 17 to be moved to the left overcoming the biasing force of spring 33. When such pressure difference reaches a predetermined value which is determined by the force of spring 33, magnet 21 is moved to the left and provides a magnetic field around contacts 26 and 27 such that they contact with each other to close the switch and establish an electric circuit.

Figure 3:
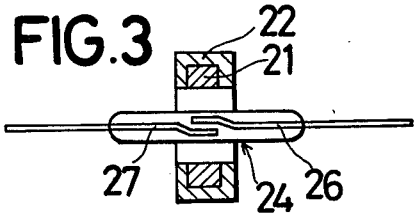
FIG. 3 is a diagram of a normally closed type switch assembly at a temperature over its Curie temperature consisting of a thermo ferrite.

In the first preferred embodiment of this invention, as previously indicated, the reed switch assembly 24 is shown in FIG. 1 as having normally open contacts over the Curie temperature of the thermo ferrite 22. It should be noted, however, that such normally open contacts will be easily modified into normally closed type by changing the relative position between thermo ferrite 22 holding magnet 21 therein and the reed switch assembly 24 as shown in FIG. 3.

Figure 4:
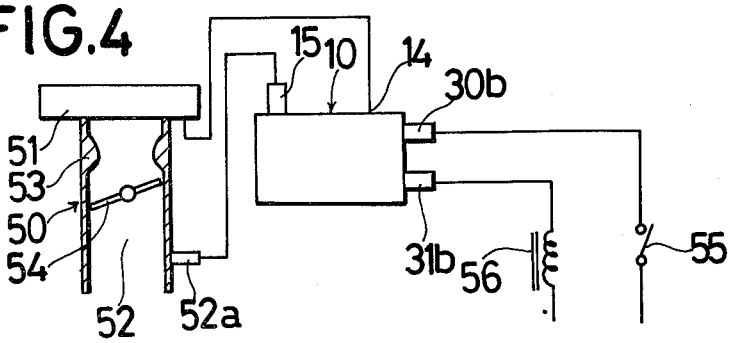
FIG. 4 is a schematic view of a deceleration fuel cutting system incorporating the differential pressure switch device of the first embodiment.

Referring to FIG. 4, there is shown a schematic illustration of a deceleration fuel cutting system in an internal combustion engine incorporating therein the above-described switch device 10 as shown in FIG. 1. When there is continuous deceleration, a large amount of mixture will remain unburned due to insufficient combustion, resulting in overheating or afterburn in the exhaust system. Accordingly, the purpose of the fuel cutting system is to cut off part of the fuel in the flow circuit of the carburetor 50 to prevent such problem.

The The carburetor 50 has an air cleaner 51 of a known type at the upper top end thereof and is connected to an engine intake manifold 52 so that air flow is produced, during the engine operation, from air cleaner 51 through venturi portion 53 and then past throttle valve 54 into the intake manifold 52. The air inlet port 14 of pressure switch device 10 is connected to the air cleaner 51, while vacuum inlet port 15 is connected to port 52*a* at a portion of the intake manifold 52 subsequent to or below the throttle valve 54.

The end 30*b* of connector 30 is connected electrically to an ignition switch 55, while the end 31*b* of connector 31 is connected electrically to a fuel cutting solenoid valve 56 positioned in carburetor 50.

When the engine temperature is below the predetermined Curie temperature of thermo ferrite 22, the thermo ferrite 22 is a magnetic substance. Accordingly, since the permanent magnet 21 forms a closed loop through thermo ferrite 22 regardless of the position of thermo ferrite 22, in other words, despite the vacuum level in second chamber 20, the reed switch assembly 24 is maintained in an open position.

When the engine temperature rises over the predetermined Curie temperature of the thermo ferrite 22, the thermo ferrite 22 is a non-magnetic substance. When there is no pressure difference between the first and second chambers 19 and 20, respectively, reed switch assembly 24 is maintained in a closed position. As the vacuum in second chamber 20 increases, cylindrical member 17 secured to diaphragm 16 is moved to the left thus overcoming the biasing force of spring 33, and the thermo ferrite 22 holding magnet 21 therein is moved to the left from the rest position thereof.

When the accelerator pedal is released for deceleration, throttle valve 54 closes to the idle position and, as a result, the intake manifold vacuum increases. When the vacuum in second chamber 20 reaches a predetermined value, permanent magnet 21 secured to cylindrical member 17 forms a closed loop through reed switch assembly 24. Under this condition, reed switch assembly 24 is closed and the battery current flows into fuel cutting solenoid valve 56. As a result, the fuel from the float chamber does not flow into the flow circuit in carburetor 50.

Figure 5:
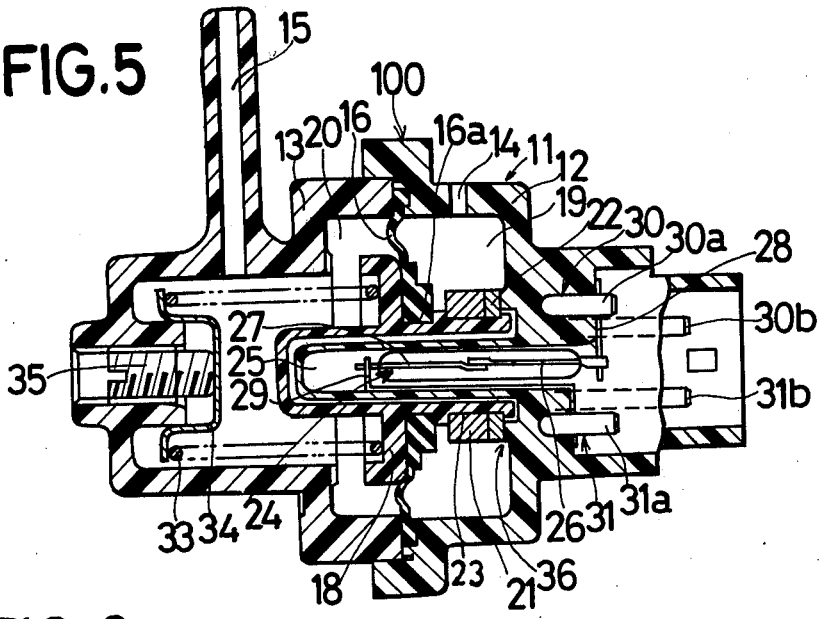
FIG. 5 is an enlarged cross-sectional view of a second embodiment of this invention.

In the second embodiment of the pressure switch device as shown in FIG. 5, similar elements serving similar functions and are provided with the same reference numeral as shown in FIG. 1. The pressure switch device of this invention is generally indicated by reference numeral 100. The thermo ferrite 22 is positioned at the right side of permanent magnet 21.

Cylindrical member 17 secured to diaphragm 16 is always biased toward the right by the force of spring 33. When there is no pressure difference between first and second chambers 19 and 20, respectively, thermo ferrite 22 is in contact with inner stop surface 36 of first housing member 12 and cylindrical member 17 is maintained in its rest position. When the magnet 21 is in its illustrated position, magnet 21 is always provides a magnetic field around contacts 26 and 27, so that reed switch assembly 24 is closed.

As the vacuum in second chamber 20 increases, magnet 21 is moved to the left from the rest position therof, overcoming the biasing force of spring 33. Thus, contacts 26 and 27 are now out of the magnetic field of magnet 21, and, as a result, reed switch assembly 24 will be open.

Figure 6:
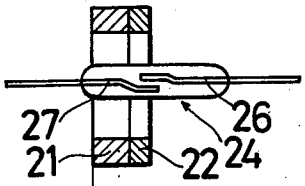
FIG. 6 is a diagram of the relative position of a permanent magnet and a reed switch assembly below the Curie temperature of the thermo ferrite.
Figure 8:
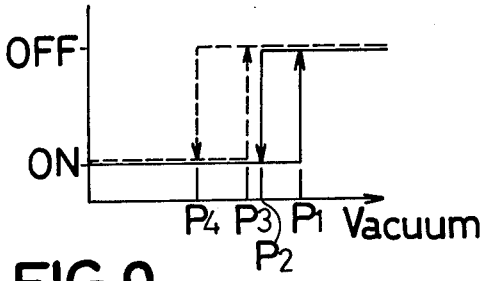
FIG. 8 is a graph of the operation of the reed switch assembly of the second embodiment.

Since thermo ferrite 22 acts as a magnetic substance below its Curie temperature, reed switch assembly 24 is actuated to be open when the relative position between the magnet 21 and the reed switch assembly 24 is that shown in FIG. 6, in other words, the vacuum in the second chamber 20 increases and reaches a vacuum value $P_1$ as shown in FIG. 8. When the vacuum in second chamber 20 decreases and reaches a vacuum value $P_2$, the reed switch assembly 24 is again actuated to be closed. That is to say, in the differential pressure switch device 100, the reed switch assembly 24 is actuated to open and close at the vacuum values $P_1$ and $P_2$, respectively, below the Curie temperature of the thermo ferrite 22.

Figure 7:
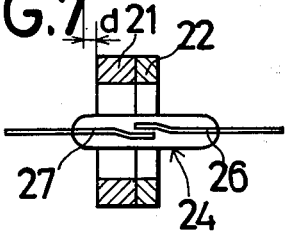
FIG. 7 is a diagram of the relative position of a permanent magnet and a reed switch assembly over the Curie temperature of the thermo ferrite.

On the other hand, since the thermo ferrite 22 becomes a non-magnetic substance over its Curie temperature, the reed switch assembly 24 is actuated to be open when the relative position between the magnet 21 and reed switch 24 is in the position shown in FIG. 7. In this case, the reed switch assembly 24 can be actuated to be open with the stroke to the left which is a distance d less than the stroke to the left in the case shown in FIG. 6. Distance d is the length equal to the thickness of the thermo ferrite 22. That is to say, as shown in FIG. 8, the reed switch 24 is actuated to open and close when the vacuum in the second chamber 20 is at a vacuum value $P_3$ less than $P_1$ and at a vacuum value $P_4$ less than $P_2$, respectively.

Thus the reed switch 24 is actuated to open and close at the vacuum values $P_1$ and $P_2$ below the Curie temperature of the thermo ferrite 22, while the reed switch 24 is actuated to open and close at the vacuum values $P_3$ and $P_4$ over the Curie temperature. The vacuum values $P_1$, $P_2$, $P_3$ and $P_4$ are adjustable by means of adjusting screw 35. The differential values between $P_1$ and $P_2$ and between $P_3$ and $P_4$ are determined by a constant number of spring 33 and by the dimensions of hysteresis of reed switch 24. The differential value between $P_1$ and $P_3$ is determined by the strength and the size of the magnet 21 and by the size of the thermo ferrite 22.

Figure 9:
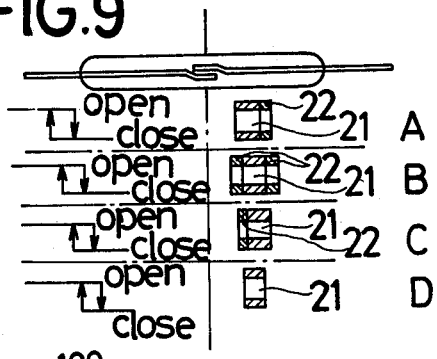
FIG. 9 is a diagram of several combinations of a magnet and a thermo ferrite in the second embodiment

FIG. 9 shows several combinations of the magnet 21 and thermo ferrite 22. A predetermined vacuum value at which switch device 100 operates is adjustable by changing the relative position between the magnet 21 and the reed switch 24 as shown in FIG. 8. Accordingly, this invention can provide a pressure switch device responsive to a temperature signal.

In the second preferred embodiment of FIG. 5 as previously indicated, when there is no vacuum in second chamber 20, the reed switch assembly 24 is shown as having normally closed contacts. It should be noted, however, that such normally closed contacts will be easily modified into normally open type contacts. In this connection, this second embodiment would correspond to embodiments A and D shown in FIG. 9 wherein the left and right arrows indicate the position of the diaphragm when the reed switch assembly is actuated to open and close.

Figure 10:
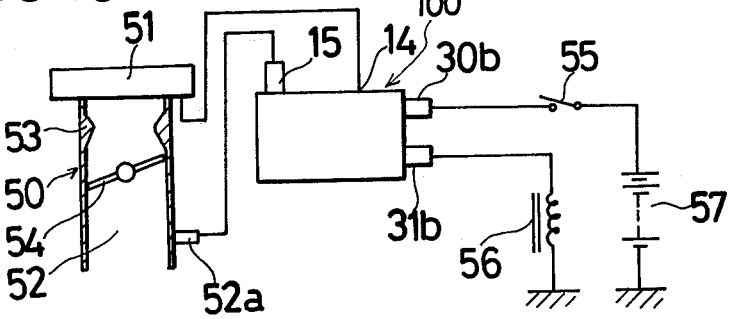
FIG. 10 is a schematic view of a deceleration fuel cutting system incorporating the pressure switch device of FIG. 5.

Now referring to FIG. 10, there is shown a schematic view of a deceleration fuel cutting system incorporating the above-noted pressure switch device 100 as shown in FIG. 5. The air inlet port 14 of pressure switch device 100 is connected to air cleaner 51 while vacuum inlet port 15 is connected to a port 52*a* at a portion of the intake manifold 52 subsequent to or below throttle valve 54. The end 30*b* of connector 30 is connected electrically to one terminal of an ignition switch 55, with the other terminal of ignition switch 55 being connected electrically to one terminal of a battery 57, and the other terminal of battery 57 being grounded to earth. The end 31*b* of connector 31 is connected electrically to one terminal of a fuel cutting solenoid valve 56 positioned in carburetor 50, and the other terminal of the solenoid valve 56 is grounded to earth.

When ignition switch 55 is actuated so as to be closed, the battery current flows into the fuel cutting solenoid valve 56 through reed switch assembly 24 which is maintained in a closed position during the operation of the engine. As a result, the solenoid valve 56 opens the flow circuit in the carburetor 50 and the fuel from the float chamber flows into the flow circuit.

When the acceleration pedal is released for deceleration, the throttle valve 54 closes to the idle position. As a result, the intake manifold vacuum increases and when the intake manifold vacuum reaches a predetermined value, the reed switch assembly 24 is actuated to open and the battery 57 current is cut. As a result, the solenoid valve 56 closes in the flow circuit of carburetor 50, and the fuel from the float chamber does not flow into the flow circuit. As the engine rotation reaches a near idle rotation, the intake manifold vacuum decreases, and the reed switch assembly 24 is actuated to be closed again.

When the engine temperature is below the predetermined Curie temperature of the thermo ferrite 22, the thermo ferrite 22 becomes a magnetic substance. Accordingly, the reed switch assembly 24 is actuated to be closed at the vacuum value $P_2$ shown in FIG. 5. As a result, the engine can again be supplied with fuel sufficiently before the engine rotation reaches the idle rotation.

When the engine temperature is over the predetermined Curie temperature of the thermo ferrite 22, the thermo ferrite 22 becomes a non-magnetic substance. Accordingly, the reed switch assembly 24 is actuated to be closed at the vacuum value $P_4$ shown in FIG. 5. As a result, the engine can be again supplied with fuel when the engine rotation reaches a value near the idle rotation.

Although the invention has been described with respect to two specific preferred embodiments thereof, obviously many variations and modifications of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A differential pressure switch device operable in response to both differential pressure and changes in temperature of an internal combustion engine to control exhaust emissions therefrom which comprises, in combination:

a single housing;

an annular flexible diaphragm rigidly secured about its periphery in said housing to divide said housing into a first chamber and a second chamber;

means for admitting fluid pressures into said chambers for moving said diaphragm in response to differential pressure between said chambers;

a movable cylindrical member secured axially in the center of said diaphragm for movement therewith;

a permanent annular magnet mounted on the outer wall of said cylindrical member for movement therewith;

a thermo ferrite connected with said magnet for operative cooperation therewith in response to said temperature changes of said engine, said thermo ferrite being positioned adjacent said magnet;

biasing means engaging said cylindrical member for biasing said cylindrical member, said magnet, and said thermo ferrite into a rest position when the differential pressure between said first and second chambers is below a predetermined value;

a reed switch assembly disposed within said cylindrical member, said reed switch being actuated upon movement of said magnet in a predetermined position as well as being actuated by said thermo ferrite when surrounding temperature reaches a predetermined degree; and means connected to said housing for controlling flow of fuel to said engine in response to actuation of said reed switch assembly.

2. A differential pressure switch device as set forth in claim 1, said means for controlling the flow of fuel to said engine further comprising a solenoid valve positioned in said engine.

3. A differential pressure switch device as set forth in claim 1, wherein said thermo ferrite covers said permanent annular magnet.

4. A differential pressure switch device as set forth in claim 3, wherein said thermo ferrite covers at least three sides of said permanent annular magnet.

5. A differential pressure switch device as set forth in claim 1, which further comprises:

a hollow projection formed integrally with said housing and disposed within said cylindrical member and wherein said reed switch assembly is mounted in said hollow projection.

6. A differential pressure switch device as set forth in claim 1, which further comprises:

means for adjusting the force of said biasing means to regulate the predetermined differential pressure at which said magnet will be moved to actuate said reed switch assembly.

7. A differential pressure switch device as set forth in claim 1, wherein said means for admitting fluid pressures includes inlet ports for connection to fluid pressure sources.

8. A differential pressure switch device as set forth in claim 1, which further comprises:

a pair of U-shaped connectors connected to said housing; and means for connecting contacts of said reed switch assembly to said pair of U-shaped connectors.

* * * * *